United States Patent [19]

Skowasch

[11] Patent Number: 5,048,419

[45] Date of Patent: Sep. 17, 1991

[54] BOMBLET FUZE

[75] Inventor: Gerhard Skowasch, Gelsenkirchen, Fed. Rep. of Germany

[73] Assignee: Rheinmetall GmbH, Düsseldorf, Fed. Rep. of Germany

[21] Appl. No.: 559,346

[22] Filed: Jul. 30, 1990

[30] Foreign Application Priority Data

Jul. 29, 1989 [DE] Fed. Rep. of Germany ..... 3925235

[51] Int. Cl.[5] ..... F42B 12/58; F42C 14/06; F42C 15/184

[52] U.S. Cl. ..... 102/226; 102/245; 102/269; 102/393

[58] Field of Search ..... 102/226–230, 102/269, 242, 393, 489

[56] References Cited

U.S. PATENT DOCUMENTS

| | | | |
|---|---|---|---|
| 1,702,133 | 4/1926 | Remondy | 102/275 |
| 3,724,384 | 4/1973 | Donahue | 102/245 |
| 3,913,483 | 10/1975 | Wolterman | 102/226 |
| 3,998,164 | 12/1976 | Hadfield | 102/226 |
| 4,455,940 | 6/1984 | Furuike | 102/230 |
| 4,612,858 | 9/1986 | Backstein et al. | 102/245 |
| 4,653,401 | 3/1987 | Gatti | 102/489 |
| 4,726,292 | 2/1988 | Gatti | 102/227 |
| 4,762,066 | 8/1988 | Rüdenauer et al. | 102/226 |
| 4,770,096 | 9/1988 | Maruska et al. | 102/229 |
| 4,811,664 | 3/1989 | Levy et al. | 102/226 |
| 4,873,927 | 10/1989 | Rüdenauer | 102/226 |

FOREIGN PATENT DOCUMENTS

| | | |
|---|---|---|
| 0284923 | 5/1988 | European Pat. Off. . |
| 0318995 | 12/1988 | European Pat. Off. . |
| 0318996 | 12/1988 | European Pat. Off. . |
| 265386 | 2/1911 | Fed. Rep. of Germany . |
| 3524080 | 1/1987 | Fed. Rep. of Germany . |
| 2607918 | 6/1988 | France . |

*Primary Examiner*—David H. Brown
*Attorney, Agent, or Firm*—Spencer & Frank

[57] ABSTRACT

A fuze for an explosive projectile, particularly a submunition projectile (bomblet) which includes a first primary firing pin mounted in a housing for axial displacement in the longitudinal direction, and a detonation charge carried by a slide disposed in the housing, with the slide being mounted for displacement transverse to the longitudinal direction of said housing, and to its center longitudinal axis, between a safety position, wherein the detonation charge is not aligned with the firing pin, and an armed position, wherein the detonation charge is aligned with the firing pin. The slide is further provided with a self destruct arrangement, which includes an ignition element disposed adjacent an edge of the slide, to cause self destruction of at least said fuze after a given time delay following ignition of the ignition element. A second firing in is mounted laterally in the fuze housing at a position for causing ignition of the ignition element upon displacement of said slide into the armed position, with the second firing pin being a flat strip of sheet metal in the shape of a pointed wedge or triangle disposed in the displacement path of the slide.

11 Claims, 2 Drawing Sheets

BOMBLET FUZE

REFERENCE TO RELATED APPLICATIONS

This application relates to and incorporated herein by reference, concurrently filed U.S. patent application Nos. 07/559,350 and 07/559,936, corresponding respectively to Federal Republic of Germany applications P 39 25 236.1 and P 39 25 238.8, both filed July 29, 1989.

This application further claims the priority of Federal Republic of Germany application Serial No. P 39 25 235.3 filed July 29, 1989, which is incorporated herein by reference.

BACKGROUND OF THE INVENTION

The present invention relates to a fuze for an explosive projectile, particularly a submunition projectile (bomblet).

More particularly the present invention relates to a fuze for an explosive projectile, particularly a submunition projectile (bomblet), which is of the type including a first primary firing pin mounted in a housing for axial displacement in the longitudinal direction, a detonation charge carried by a slide disposed in the housing adjacent the primary firing pin, with the slide being mounted for displacement transverse to the longitudinal direction of the housing (and to its center longitudinal axis) between a safety position, wherein the detonation charge is not aligned with the firing pin, and an armed position, wherein the detonation charge is aligned with the firing pin, and a self destruct arrangement provided in the slide, and including an ignition element disposed adjacent an edge of the slide, for causing self destruction of at least the fuze after a given time delay following ignition of the ignition element by a second firing pin, which is mounted in the fuze housing, upon displacement of the slide into the armed position.

Such a bomblet fuze including an axially unscrewable primary firing pin and a slide that is displaceable transversely to the longitudinal direction of the projectile and fuze housing from a safety position into a armed position is disclosed, for example, in EP 0,284,923.A2, corresponding to U.S. Pat. No. 4,811,664. The slide includes an ignition element for a pyrotechnic delay path that is ignited by a second firing pin for self-destruction of the projectile if the detonator has not been actuated by the primary firing pin upon impact on the target. This may happen, for example, if such a secondary projectile (bomblet) ejected from a carrier projectile lands in soft ground, in a swamp, in snow, in tree branches or in a camouflage net.

One drawback in this prior art bomblet construction is the fact that the slide, when the ignition device is in the armed position, projects far and unprotected from the side of the fuze housing. In rainy weather, for example, this may easily produce malfunctions in the firing of the detonation charge or in the firing of the exposed ignition element for the delay charge for self-destruction.

Another drawback of this known arrangement is the arrangement of the second firing pin for igniting the ignition element at the outer, unprotected end of the slide itself which projects far from the side of the fuze housing. This second firing pin is provided with a heavy percussion member and is rotatably fastened to the slide by means of a pin. In the armed position attained by transverse displacement of the slide partially out of the fuze housing, the percussion member is to become effective due to centrifugal forces generated from the inherent rotation of the bomblet and the solid firing pin is to perform a movement of about 90° on a small-radius partial circle so as to enter into the ignition element. The firing pin tip has the shape of a solid cone which is flattened on one side, possibly in order to facilitate entry into the ignition element over a small circular arc. This fuze construction has the further great drawback that the slide which projects far from the fuze housing and the heavy firing pin-percussion member assembly on its exterior create eccentricities during rotation and thus cause destabilizing forces to act on the bomblet.

Federal Republic of Germany DE-OS 3,333,312, corresponding to U.S. Pat. No. 4,612,858, discloses a further bomblet fuze with a self-destruct capability. In this arrangement, a solid, conical second firing pin is fastened to the interior housing wall in order to activate the ignition composition and the delay composition for self-destruction of the bomblet. The drawback of this prior art bomblet fuze is the solid, conical firing pin and the spatial arrangement of the delay composition in the fuze housing between the slide and primary explosive charge. This increases the structural height of the fuze and the ignition composition is not connected in one piece with the delay path so that the ignition must occur "around the corner" so to speak.

Moreover, each ignition element for the delayed charge is provided with an injection opening that is covered by a foil and is entered by the injection pin, that is the firing pin, to initiate the charge. The prior art second firing pin in solid, conical form more or less closes this opening during the ignition process, depending on how deep the pin penetrates. For secure ignition, the firing pin should penetrate as deeply as possible, but then the injection opening is closed completely and the poor provisions for dissipation of the developing combustion gases may cause the ignition to die out.

SUMMARY OF THE INVENTION

It is an object of the present invention to provide an improved fuze for a secondary projectile (bomblet), in which the above described drawbacks do not occur, in which safe ignition is ensured, and wherein the structural height of the fuze as well as its weight, that is its percentage of dead weight, is reduced.

The above object is achieved according to the present invention by a fuze for an explosive projectile, particularly a submunition projectile (bomblet), which is of the type including: a fuze housing; a first primary firing pin mounted in the housing for axial displacement in the longitudinal direction; a detonation charge carried by a slide disposed in the housing adjacent the primary firing pin, with the slide being mounted in the housing for displacement transverse to the longitudinal direction of the housing, and to its center longitudinal axis, between a safety position, wherein the detonation charge is not aligned with the firing pin, and an armed position, wherein the detonation charge is aligned with the firing pin; self destruct means provided in the slide, and including an ignition element disposed adjacent an edge of the slide, for causing self destruction of at least the fuze after a given time delay following ignition of the ignition element; and a second firing pin mounted laterally in the fuze housing at a position for causing ignition of the ignition element upon displacement of the slide into said armed position; and wherein the second firing pin is a flat strip of sheet metal in the form of a pointed wedge or triangle disposed in the displacement path of the slide.

With the arrangement according to the invention, the extremely flat configuration of the second firing pin results in improved dissipation of the developing combustion gases from the ignition composition since the cross section of the injection opening is not closed by the flat, pointed tip of the firing pin and the combustion gases can escape unimpededly from the ignition opening of the ignition composition above and below the flat firing pin. Due to the better dissipation of the gases, the combustion, moreover, becomes more uniform and, in particular, constant, identical delay times are realized with simultaneous ignition/activation of a plurality of bomblets ejected from the carrier projectile.

Advisably, the second firing pin is an integrated component (connected in one piece) of a circular spring disc made of thin sheet metal and provided in its center region with a strip-like spring tab which, when the slide is in the armed position, engages in a recess disposed in the lower surface of the slide, thus preventing the slide from recoiling and fixing the slide securely in its armed position. Advantageously, the spring tab is not charged when the slide is in the safety position, but is depressed only upon transverse displacement of the slide so that the spring is not subjected to any fatigue phenomena over long periods of storage.

The present invention will be described below in greater detail with reference to an embodiment thereof illustrated in the drawing figures.

DETAILED DESCRIPTION OF THE PREFERRED EMBODIMENT

Figure 1:
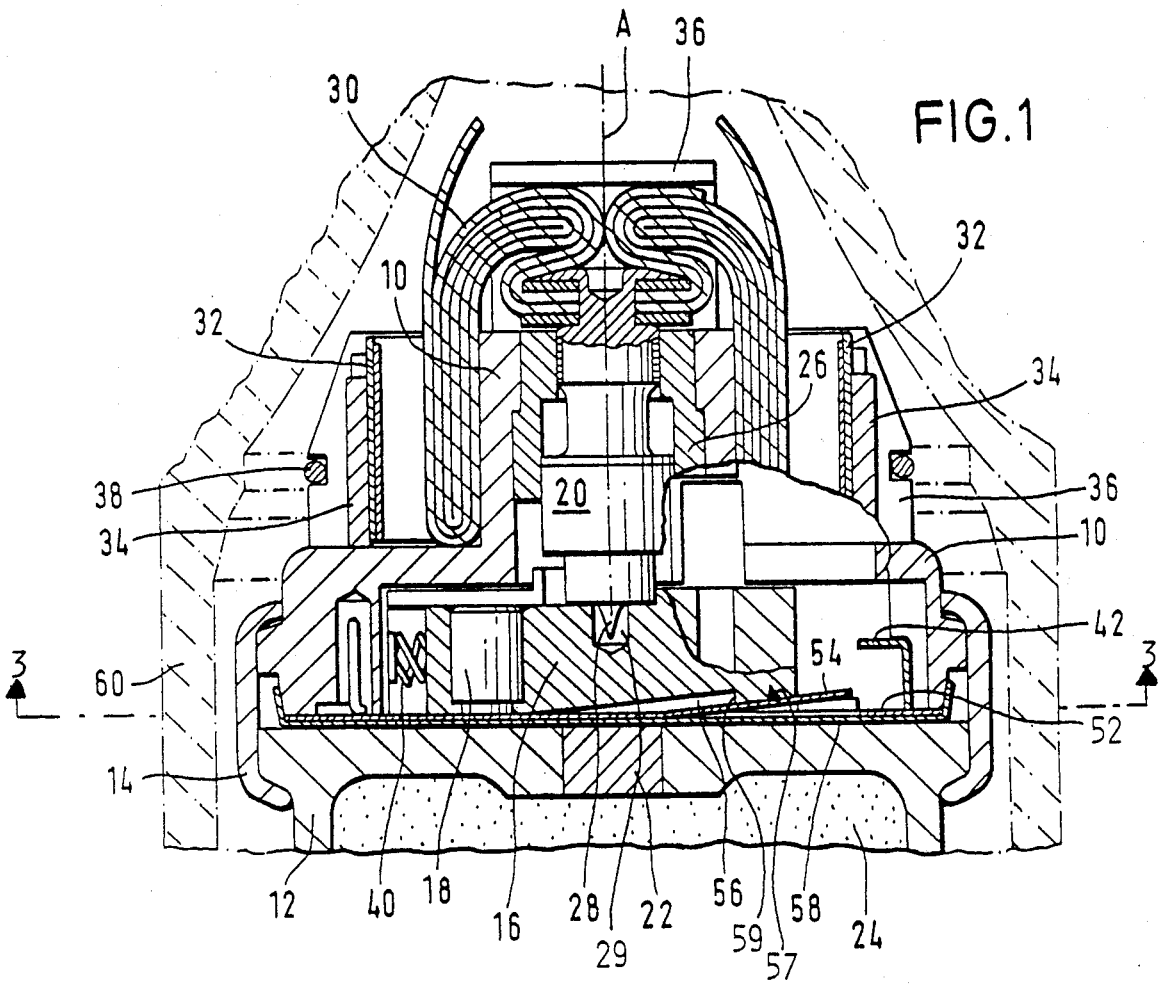
FIG. 1 is a longitudinal sectional view, partially broken away, of a bomblet fuze housing according to the present invention.

Referring now to FIG. 1, there is shown a fuze housing 10 which is firmly fixed by means of a holding ring 14 on a bomblet housing 12. Within fuze housing 10, there is disposed a slide 16 which contains a detonation charge 18 and which is displaceable transverse to the center longitudinal axis A of the bomblet projectile.

FIG. 1 shows slide 16 in the safety position, in which the detonation charge 18 is displaced to the side out of the straight line between a primary firing pin 20 disposed in the fuze housing 10 and a booster charge 22 disposed in the upper bomblet housing 12 for igniting the primary explosive charge 24. In a known manner, the centrally arranged primary firing pin 20 is connected via a screw connection with a casing 26 which is axially displaceable in fuze housing 10 and serves as additional percussion mass. In the illustrated safety position, firing pin 20 is screwed into casing 26 so that the pin is supported toward the top and rear against a projection on the fuze housing 10. At the front, the tip 28 of primary firing pin 20 projects into a recess (blind bore) 29 disposed on the upper surface of slide 16 and thus fixes slide 16 in the safety position.

A folded stabilization band 30 is fastened to the end of primary firing pin 20 projecting from fuze housing 10. Two radially outwardly pivotal, semicircularly bent spin braking fins 32, e.g. made of thin steel sheet, are fastened to the exterior of fuze housing 10 so as to enclose the upper smaller-diameter region of fuze housing 10. A coiled band 34 is placed around the folded, i.e., non-deployed spin braking fins 32. Coiled band 34 and stabilization band 30 are held in their wound position by a two-part plastic clamp 36 which is pushed over them and which, in turn, is held in position by a holding ring 38 of spring steel.

During transport into a target area by means of a large-caliber carrier projectile which can be fired over large distances, for example 30 km, the secondary projectiles or bomblets are stacked within the carrier projectile in the form of space saving columns. FIG. 1 shows, in dashed lines, such an adjacent bomblet 60 which completely covers fuze housing 10. Fuze housing 1 projects far into the conical free space provided by the shaped charge liner of the adjacent bomblet 60.

When the bomblet projectiles are ejected from the carrier projectile over the target area by means of an ejection charge and the stack arrangement no longer exists, several steps take place in timely succession within a predetermined period of time from the bomblet fuze being in the safety position until it is set to detonate.

Initially, stabilization loop 30 on the exterior is pulled out of its folded-in rest position and unfolded. At the same time, the plastic clamp 36 and holding ring 38 snap away from fuze housing 10 and release coiled band 34 Then the discardable coiled band 34 is unwound and releases the spin braking fins 32 which, due to the centrifugal forces caused by rotation, pivot outwardly and reduce the spin of the bomblet projectile which now drops in a stabilized manner.

Once stabilization loop 30 has been unfolded, a torque acts on firing pin 20 causing it to be screwed somewhat toward the rear out of casing 26. This causes the tip 28 of firing pin 20 to come out of the recess 29 in the upper surface of the slide 16 and the slide is able to snap via transverse displacement, and if further separately acting safety devices or arrangements have been released, into its armed position with the detonator 18 aligned with the firing pin 20.

For this purpose, the center of gravity of slide 16 is set so that, in the safety position of the slide 16, the center of gravity is disposed next to center axis A and on the left in FIG. 1, thus causing the centrifugal forces generated in connection with fast spinning of the housing 10 to urge slide 16 (to the left) against the force of a compression spring 40. As soon as the spin and the centrifugal forces have been reduced somewhat by the spin braking fins 32, the pressure of the spring 40 predominates and displaces the slide 16 to the right somewhat in the direction of a second firing pin 42. As soon as the center of gravity has gone beyond the center axis A (to the right in FIG. 1), the pressure of spring 40 and the reactivation of centrifugal forces cause slide 16 to snap into its armed position.

The second firing pin 42 is disposed laterally within the fuze housing 10 for initiating an ignition element or primer 44, which is disposed on an edge of end surface of the slide 16, for a self destruct arrangement which further has a pyrotechnic delay path 46 including a booster charge 48 and an explosive charge 50 arranged in close proximity to the booster charge 18. The second firing pin 42 is configured in the form of a flat sheet metal strip which has the shape of a pointed wedge or triangle as can clearly be seen in FIG. 3. Due to this shape, the second safety pin 42, in order to safely initiate the charge, is able to penetrate deeply into the ignition composition or primer 44 without interfering with the outflowing of the developing combustion gases.

Figure 2:
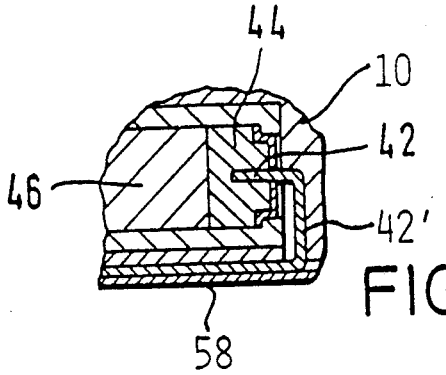
FIG. 2 is a partial sectional view of an ignition device for a delay path including a second firing pin according to the invention.
Figure 3:
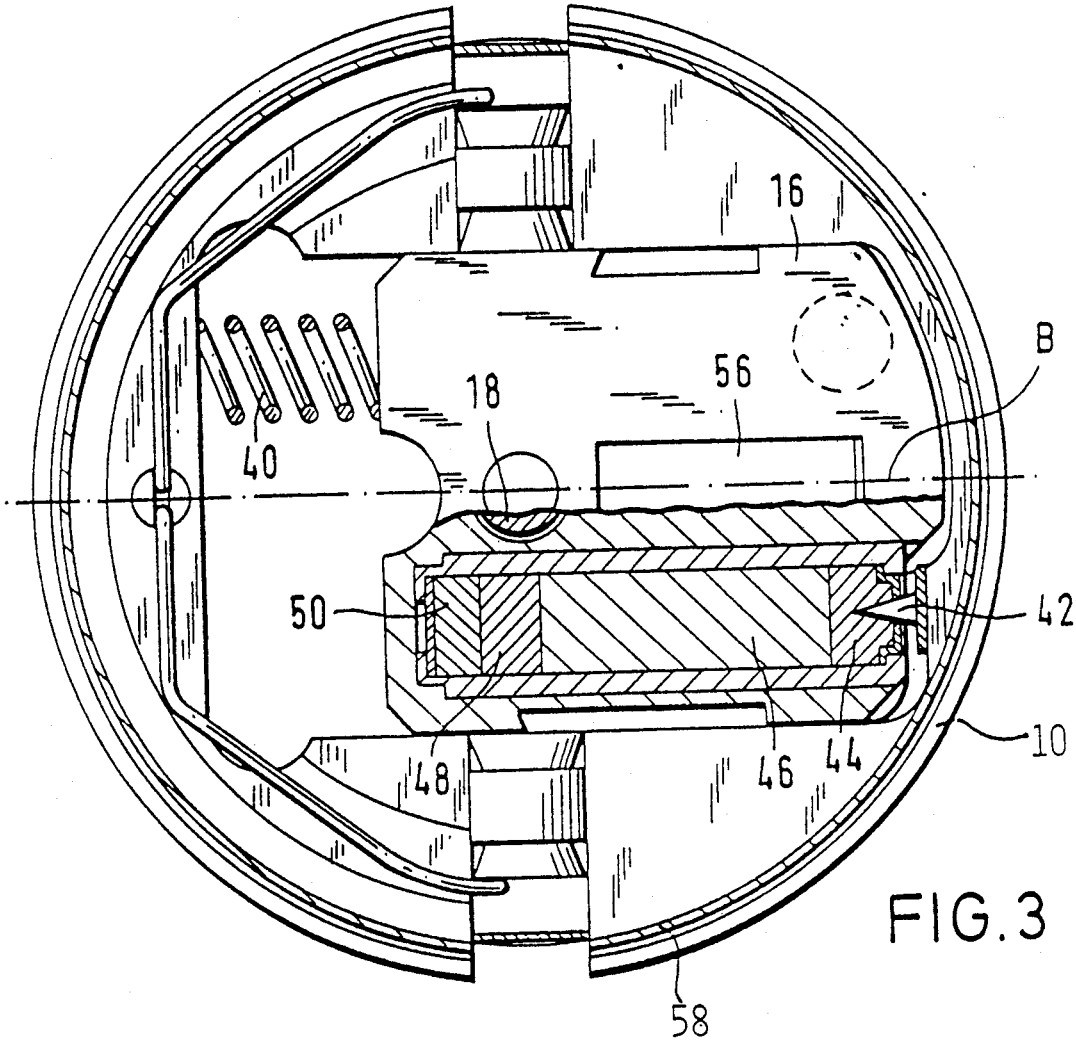
FIG. 3 is a cross-sectional view of only the fuze housing in the direction 3—3 of FIG. 1 and showing the slide partially in section.

The second firing pin 42 constitutes a inwardly bent end portion of integrated tongue-like upwardly bent strip 42' of sheet metal in a flat sheet metal spring disc 52 which is disposed in direct proximity to the underside or lower surface of the slide 16 and covers the entire cross section of the fuze housing 10. The tongue-like, upwardly bent portion 42' for the second firing pin 42, which portion 42' extends perpendicular to sheet metal spring disc 52, is laterally supported on its rear side by the inner wall of fuze housing 10 as can clearly be seen in FIG. 2. Advisably, the material, i.e. the sheet metal, of the second firing pin 42 and of sheet metal spring disc 52 has a thickness of 0.1 to 0.8 mm, preferably about 0.4 mm. As can be seen in FIG. 3, the second firing pin 42 is arranged asymmetrically relative to the transverse center axis B of slide 16 in a direct line with the ignition element 44 for the pyrotechnic delay path 46 whose end region, including booster charge 48 and explosive charge 50, lies directly next to the main detonator charge 18.

Advisably, sheet metal spring disc 52 includes an integrated upwardly inclined spring tab 54 which, when the slide 16 is in the armed position, is in operative blocking connection with a corresponding recess 56 in the underside of slide 16. With this arrangement, if slide 16 has been shifted into the armed position, further transverse movement of the slide 16 is arrested or blocked by spring tab 54 engaging in the recess 56 on the underside of slide 16. In prior art embodiments for securing the slide by means of a spring tab, the prior art spring tab constantly pressed on the slide when the latter was in the safety position. With low rotational velocities, the centrifugal force or a spring force often was not sufficient to overcome the friction between the prior art spring tab and the slide and move the slide into the armed position as well as generate the then required injection energy for the second firing pin. To avoid this prior art problem, according to the present invention, the portion 57 of the lower surface of the slide 16 in front of recess 56, i.e. the portion which overlies the tab 54 when the slide is in the safety position, is formed as an upwardly inclined or sloped step, whereby the leading longitudinally extending edge 59 defining the recess does not extend to the lower surface of slide 16, such that there is substantially no depression of the tab 54 when the slide 16 is in the safety position. Consequently, there is no load exerted on the slide 16 nor on the spring tab 54 in the safety position. The slide 1 will depress spring tab 54 only during the transverse displacement movement of the slide into the armed position. In the armed position, spring tab 54 then snaps into recess 56 in slide 16 and prevents the latter from moving out of this armed position.

Sheet metal spring disc 52 is fastened to the fuze housing 10 by means of a thin-walled covering hood 58 which passes around the exterior of fuze housing 10. Advisably, the covering hood 58 is formed of sheet metal which has the same thickness as sheet metal spring disc 52.

As soon as slide 16 has reached its armed position, in which ignition element 4 is ignited by the second firing pin 42, spring tab 54 engages in recess 56 and fixes slide 16 in this position. Thus the detonation charge 18 is now disposed in a line precisely below the tip 28 of primary firing pin 20 which, in the normal case where the bomblet hits the target hard, impacts on and initiates the detonation charge 18 which causes booster charge 22 and thus primary explosive charge 24 to be ignited and detonated.

To provide for problem-free transfer of the ignition of detonator charge 18 to the booster charge 22 located in bomblet housing 12, the sheet metal spring disc 52 and the thin covering hood 58 may be provided with a central bore.

If, after a given period, for example, 15 seconds, of dropping or descent of the bomblet projectile following ejection from the carrier projectile, the detonation charge 18 has not been ignited by the primary firing pin 20, due, for example, to soft impact of the projectile on the target area, then the delay composition set or path 46 will burn through and after, for example, 20 seconds, will ignite booster charge 46, which develops a high combustion temperature, and the explosive charge 50. This, in turn, will activate the detonation charge 18 disposed next to the charge 50 over a short distance. The explosive charge 50 can detonate the detonation charge 18 in a well known member as indicated for example in U.S. Pat. No. 873,927.

The construction of the bomblet fuze according to the present invention reduces the structural height and the weight of the fuze while ensuring problem-free ignition of the ignition element for subsequent self-destruction and detonation of the bomblet in any case.

The invention now being fully described, it will be apparent to one of ordinary skill in the art that any changes and modifications can be made thereto without departing from the spirit or scope of the invention as set forth herein.

What is claimed is:

1. In a fuze for an explosive projectile, including: a fuze housing; a first primary firing pin mounted in said housing for axial displacement in the longitudinal direction; a detonation charge carried by a slide disposed in said housing adjacent and below said primary firing pin, said slide being mounted in said housing for displacement transverse to said longitudinal direction of said housing, and to its center longitudinal axis, between a safety position, wherein said detonation charge is not aligned with said firing pin, and an armed position, wherein said detonation charge is aligned with said firing pin; self destruct means provided in said slide, and including an ignition element disposed adjacent an edge of said slide, for causing self destruction of at least said fuze after a given time delay following ignition of said ignition element; and a second firing pin mounted laterally in said fuze housing at a position for causing ignition of said ignition element upon displacement of said slide into said armed position; the improvement wherein said second firing pin is a flat strip of sheet metal in the shape of a pointed wedge disposed in the displacement path of said slide, and is an inwardly bent end portion of an integrated, tongue-like, upwardly bent sheet-metal strip member of a flat sheet metal spring disc disposed in the direct proximity of a lower surface of said slide and extending over the entire cross sectional area of said fuze housing.

2. A fuze as defined in claim 1 wherein said sheet metal of said second firing pin has a thickness of 0.1 to 0.8 mm.

3. A fuze as defined in claim 1 further comprising means for blocking displacement of said slide out of said armed position including a normally upwardly inclined integrated spring tab on said sheet metal spring disc, and a recess which is provided in said lower surface of said slide and which, when said slide is in said armed position, is engaged in a blocking operative connection by said spring tab.

4. A fuze as defined in claim 3 wherein the portion of said lower surface of said slide disposed between an edge of said slide facing said second firing pin and said recess, and disposed above said spring tab when said slide is in said safety position, is provided with an upwardly sloped step, whereby said spring is substantially non-stressed while said slide is in said safety position.

5. A fuze as defined in claim 3 wherein said tongue-like, upwardly bent member extends perpendicular to said sheet metal spring disc and is laterally supported by an inner wall of said fuze housing.

6. A fuze as defined in claim 1 wherein said tongue-like, upwardly bent member extends perpendicular to said sheet metal spring disc and is laterally supported by an inner wall of said fuze housing.

7. A fuze as defined in claim 6 wherein said sheet metal of said spring firing pin and of said sheet metal spring disc has a thickness of 0.1 to 0.8 mm.

8. A fuze as defined in claim 7 wherein said sheet metal has a thickness of approximately 0.4 mm.

9. A fuze as defined in claim 1 wherein said second firing pin is disposed asymmetrically to a transverse center axis of said slide and in a direct line with said ignition element.

10. A fuze as defined in claim 9 wherein said self destruct means further includes a pyrotechnic delay path which is ignited by said igniter element, a booster charge disposed at an end region of said delay path, and an explosive charge which is activated by said booster charge and which is disposed directly adjacent to said detonation charge.

11. A fuze as defined in claim 10 wherein said igniter charge, said delay path, said booster charge and said explosive charge are arranged in a straight line.

* * * * *